US006508463B1

(12) United States Patent
Auerbach et al.

(10) Patent No.: US 6,508,463 B1
(45) Date of Patent: Jan. 21, 2003

(54) METHOD AND APPARATUS FOR STAGING ENVELOPES

(75) Inventors: David Auerbach, West Redding, CT (US); Carlos de Figueiredo, Sandy Hook, CT (US); John W. Sussmeier, Cold Spring, NY (US); William Wright, Killingworth, CT (US); Karel J. Janatka, Southbury, CT (US)

(73) Assignee: Pitney Bowes Inc., Stamford, CT (US)

( * ) Notice: Subject to any disclaimer, the term of this patent is extended or adjusted under 35 U.S.C. 154(b) by 168 days.

(21) Appl. No.: 09/696,131

(22) Filed: Oct. 26, 2000

(51) Int. Cl.[7] ..... B65H 5/00

(52) U.S. Cl. ..... 271/2; 271/258.01; 271/259; 271/261; 271/266; 271/176

(58) Field of Search ..... 271/2, 258.01, 271/259, 261, 266, 176; 270/58.06; 53/569

(56) References Cited

U.S. PATENT DOCUMENTS 4,501,417 A * 2/1985 Foster et al. ..... 271/124
4,753,429 A * 6/1988 Irvine et al. ..... 271/184 X
5,660,030 A * 8/1997 Auerbach et al. ..... 53/569
5,944,304 A * 8/1999 Branecky et al. ..... 271/2
5,992,132 A * 11/1999 Auerbach ..... 53/569
6,098,374 A * 8/2000 Yates et al. ..... 53/569 X
6,234,468 B1 * 5/2001 Janatka et al. ..... 271/2

* cited by examiner

*Primary Examiner*—David H. Bollinger
(74) *Attorney, Agent, or Firm*—Christopher J. Capelli; Angelo N. Chaclas

(57) ABSTRACT

A method and apparatus for staging envelopes in a mail insertion machine. In the mail insertion machine, envelopes are moved into an envelope inserting area one at a time with the flap of the envelopes trailing the envelope bottom edge and flipped away so as to allow enclosure material to be inserted into the envelope. While one envelope is paused in the envelope inserting area for receiving enclosure material, the next envelope is moved towards the envelope inserting area such that the flap of the paused envelope in the envelope inserting area is partially overlapped with the next envelope in a shingling fashion. In order to properly separate these envelopes, a sensing device is used to sense the arrival of the bottom edge of the next envelope in order to control the further movement of the next envelope.

10 Claims, 5 Drawing Sheets

METHOD AND APPARATUS FOR STAGING ENVELOPES

TECHNICAL FIELD

The present invention relates generally to a mail inserting machine and, more particularly, to the envelope staging area in a mail insertion machine.

BACKGROUND OF THE INVENTION

In a mail insertion machine, there is an envelope feeder on one end of the machine to sequentially release envelopes into an envelope inserting area. On the other end of the mail insertion machine, there is a gathering section where enclosure material is released and gathered. If the enclosure material contains a number of documents, the documents are separately released from a plurality of enclosure feeders. The released documents are then collated into a stack to be moved into the envelope inserting area where the document stack is inserted into the envelope. Envelopes can be fed from below the envelope inserting area by a lower envelope transport system. Usually, the flap of each envelope is flipped away from the throat of the envelope as the envelope is transported from the envelope feeder toward the envelope inserting area.

Mail insertion machines are well known. For example, U.S. Pat. No. 4,501,417 (Foster et al.) discloses an inserter feeder assembly for feeding enclosures; U.S. Pat. No. 4,753,429 (Irvine et al.) discloses a collating station; and U.S. Pat. No. 5,660,030 (Auerbach et al.) discloses an envelope inserting station wherein envelopes are separately provided to an envelope supporting deck where envelopes are spread open in order to allow enclosure material to be stuffed into the envelopes.

In a typical mail insertion machine, only one envelope is placed at the envelope inserting area at anytime to receive enclosure material. The following envelope must wait at a staging position so that it will not interfere with the insertion of the enclosure material into the envelope located in the envelope inserting area. As soon as the enclosure material is inserted in the envelope, the stuffed envelope is moved out of the envelope inserting area so that the following envelope can enter into the inserting area to receive enclosure material. In a high-speed mail insertion machine, it is important to keep the waiting envelope very close to the envelope located in the inserting area in order to reduce the time required to transport this waiting envelope into the position for mail insertion. At the same time, these envelopes must also be kept at a proper distance from each other.

Thus, it is advantageous and desirable to provide a method and apparatus for staging the envelopes so that the envelope next in line to receive enclosure material is placed at a precise distance relative to the envelope already located in the inserting area for mail insertion.

SUMMARY OF THE INVENTION

The first aspect of the present invention is to provide a method for placing a first envelope behind a preceding second envelope which is located at an envelope inserting area of a mail insertion machine to receive enclosure material, wherein both the first and second envelopes have a first end and an opposing second end, and wherein the first envelope is advanced towards the envelope inserting area with the first end leading the second end, and the first end of the first envelope is closer to the second end of the second envelope than the first end thereof. The method comprises the steps of sensing the arrival of the first end of the first envelope at a reference point and, responsive to the sensing, further advancing the first envelope toward the envelope inserting area by a predetermined distance so that the first envelope is paused at a staging position with the first end of the first envelope being located between the reference point and the second end of the second envelope, wherein when the first envelope is located at the staging position, the first end of the first envelope is separated from the second end of the second envelope by a predetermined gap.

Preferably, the predetermined gap is 0.75 inch.

The second aspect of the present invention is an apparatus for placing a first envelope behind a preceding second envelope which is located at an envelope inserting area in a mail insertion machine to receive enclosure material, wherein both the first and second envelopes have a first end and an opposing second end, and wherein the first envelope is advanced towards the envelope inserting area with the first end leading the second end, and the first end of the first envelope is closer to the second end of the second envelope than the first end thereof. The apparatus comprises a sensing device for sensing the arrival of the first end of the first envelope at a reference point which is located away from the second end of the second envelope and further away from the first end thereof and for providing a signal indicative of the sensing; and a transporting device, responsive to the signal from the sensing device, for further advancing the first envelope by a predetermined distance so that the first envelope is paused at a staging position with the first end of the first envelope being located between the reference point and the second end of the second envelope.

Preferably, the sensing device is a photosensor.

Preferably, the transporting device is a motor.

The present invention will become apparent upon reading the description taken in conjunction with FIGS. 1–4*b*.

DETAILED DESCRIPTION

Figure 1:
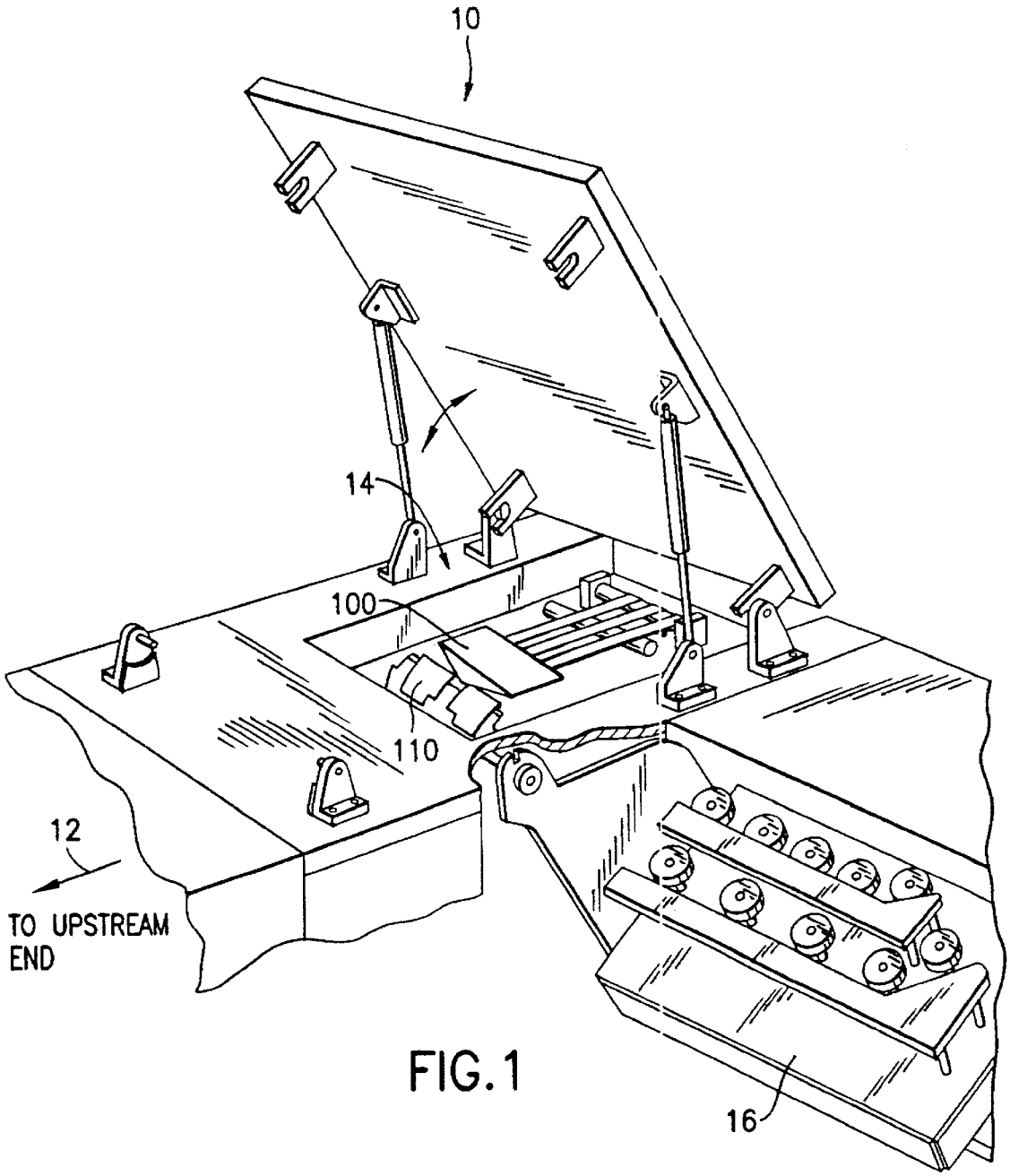
FIG. 1 is a perspective view showing part of a mail insertion machine having an envelope inserting area.

FIG. 1 shows part of a typical mail insertion machine 10. As shown in FIG. 1, the mail insertion machine 10 has a gathering section (not shown) at its upstream end, as indicated by an arrow 12, where enclosure material is gathered and collated into a stack to be moved into an envelope inserting area 14. As shown, an envelope 100 is placed in the envelope inserting area 14 to receive enclosure material (not shown) from the gathering section and an envelope 110 which is next in line to be transported into the envelope inserting area 14 for mail insertion. The envelopes 100, 110 are fed from a feeder, part of which is denoted by numeral 16.

Figure 2:
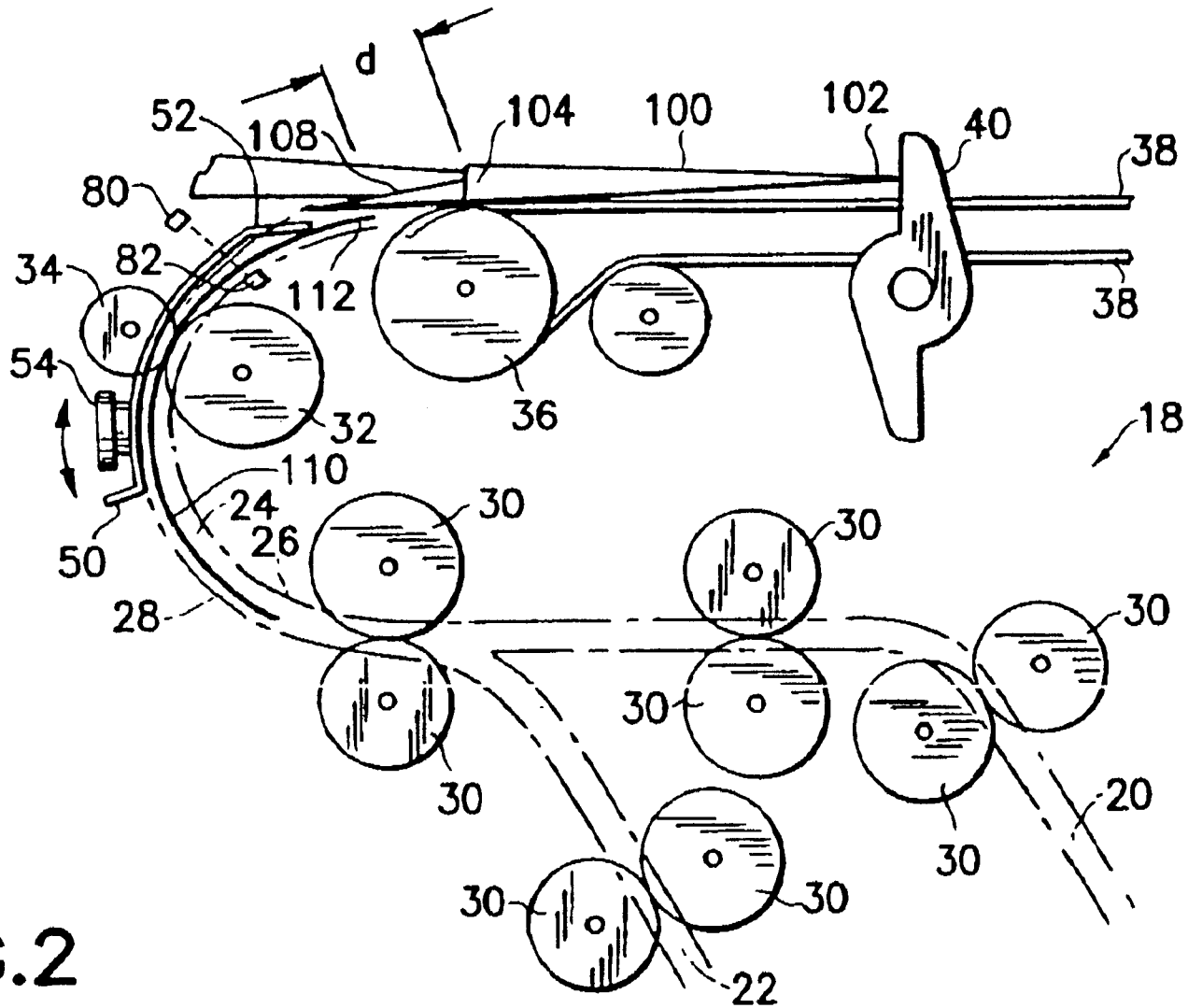
FIG. 2 is a diagrammatic representation illustrating a lower transport for moving envelopes into the envelope inserting area.

FIG. 2 shows part of a lower transport 18 for moving envelopes towards the envelope inserting area 14. In this particular mail insertion machine, there are two channels 20, 22 for alternately moving one envelope at a time by a plurality of rollers 30 from the feeder 16 through a common channel 24 towards the envelope inserting area 14. The common channel 24 is defined by an inner curved panel 26 and an outside curved panel 28. As shown in FIG. 2, the envelope 100 located in the envelope inserting area 14 has a first end 102 and a second end 104 adjoining a flap 106. The second end 104 of the envelope 100 is stopped by an envelope stopping device 40 in the envelope inserting area 14, and the flap 106 is flipped away from the second end 104. At the same time, the throat section 108 of the envelope 100 is spread open for mail insertion. The envelope 110, which is next in line to receive enclosure material, is transported towards the envelope inserting area 14 by rollers 32 and 34. The envelope 110 has a first end 112 and a second end 114. As shown, the envelope 110 is placed at a staging position by a staging device 50 mounted on the common channel 24 which is used for shingling the first end 112 of the envelope 110 under the flap 106 of the preceding envelope 100 in a slightly overlapping fashion. A pair of photosensors 80, 82 are used to sense the arrival of the first end 112 of the envelope 110.

It is preferred that the first end 112 of the envelope 110 is separated from the second end 104 of the envelope 100 by a fixed distance d when the envelope 100 is located in the envelope inserting area 14 to receive enclosure material and the envelope 110 is paused to wait for the envelope 100 to move out of the envelope inserting area 14. For example, the distance d can be 0.75 inch. However, the distance d can also be greater or less than 0.75 depending on the moving speed of the envelopes from the staging position to the envelope inserting area 14. After the envelope 100 is stuffed with enclosure material and moved out of the inserting area 14, the envelope 110 is moved into the inserting area 14 by the rollers 32, 34 and is picked up by a take-over roller 36 and a transport belt 38.

Figure 3A:
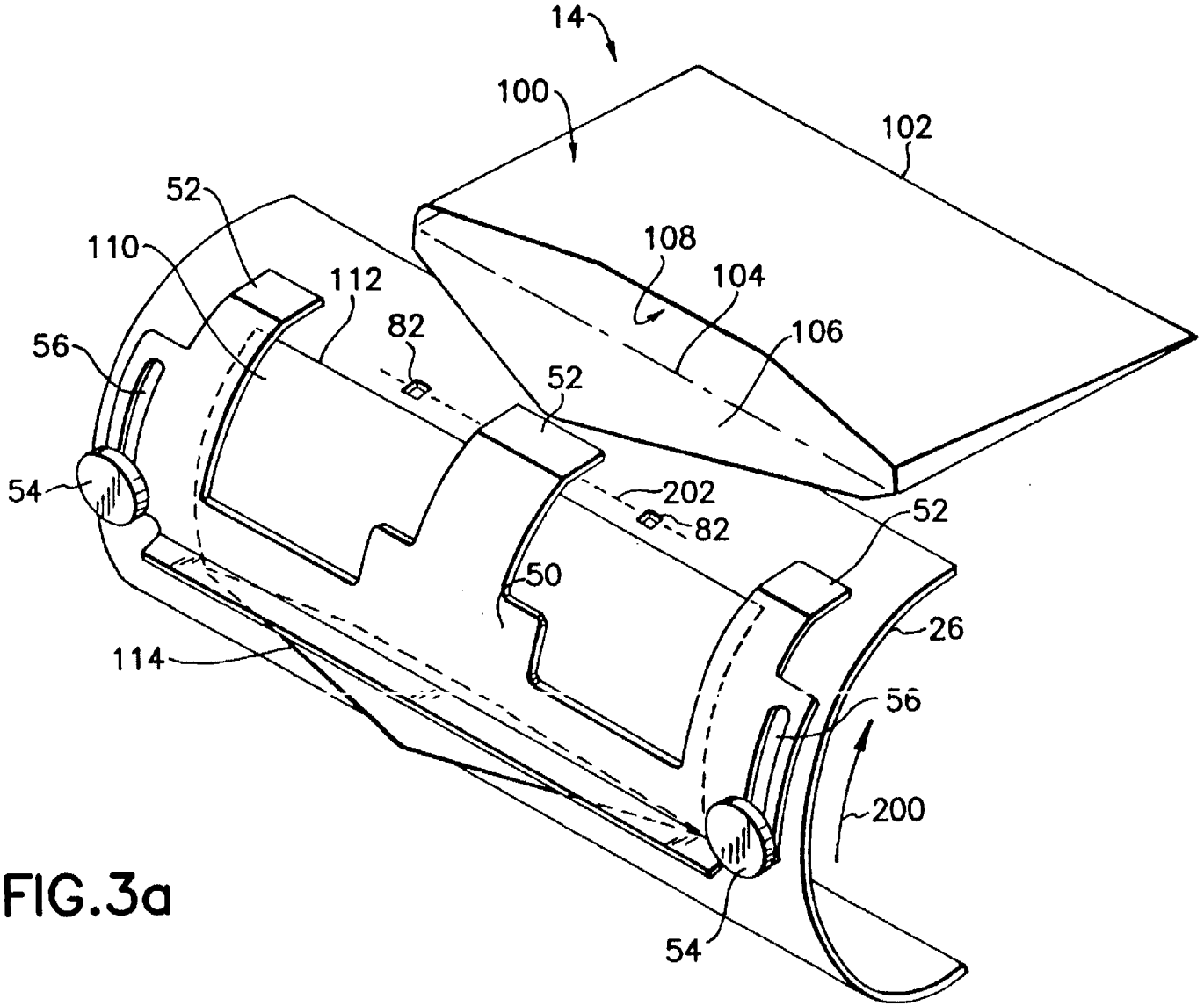
FIG. 3*a* is a diagrammatic representation illustrating the envelope, which is next in line to receive enclosure material being transported towards the envelope inserting area.
Figure 3B:
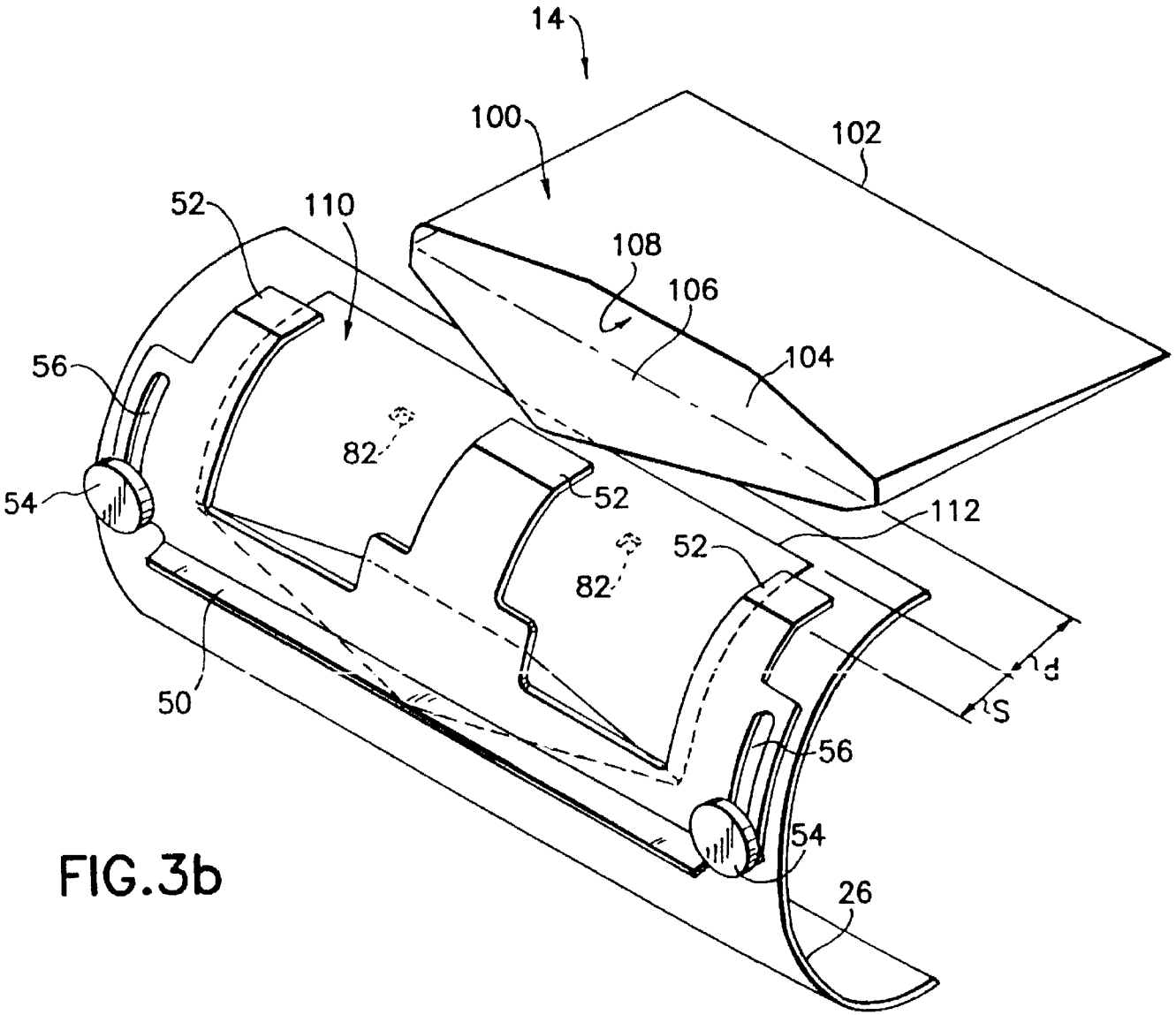
FIG. 3*b* is a diagrammatic representation illustrating the same envelope being paused at a staging position behind the preceding envelope, which is located in the envelope inserting area.

FIGS. 3*a* and 3*b* illustrate the staging of the envelope 110 near the inserting area 14. For simplicity, only the inner panel 26 of the common channel 24 (see FIG. 2) is shown in FIGS. 3*a* and 3*b*. As shown, the inner panel 26 and the staging device 50 confine the movement of the envelope 110 with the movement being denoted by an arrow 200. The staging device 50 has a plurality of fingers 52 to control the position of the flap of an envelope as the envelope moves towards the inserting area 14. An envelope is always located below the staging device 50 while it is moved by the rollers 32, 34 and the take-up roller 36 until the flap is cleared of the fingers 52. It should be noted that the staging device 50 also has two locking knobs 54 and matching slots 56 so as to allow the staging device to be adjusted to suit the size and shape of the envelope 110. As shown in FIG. 2, once the flap 106 of the envelope 100 is cleared of the fingers 52, it moves slightly upward so as to allow the first end 112 of the envelope 110 to be tugged under the flap 106 of the envelope 110 such that the flap 106 is partially overlapped with the first end 112 of the envelope 110 in a shingling fashion. As shown in FIGS. 3*a* and 3*b*, the flap 106 has passed the fingers 52. It is preferred that two photosensors 82 are placed in the path of the envelope 110 to sense the arrival of the leading edge, or the first end 112, of the envelope 110. The photosensors 82 can be placed along a line 202 which is substantially perpendicular to the moving direction 200 of the envelope 110 so that they can determine whether the envelope 110 is fed properly into the envelope inserting area 14 or it is skewed. After the first end 112 is sensed by the photosensors 82, the envelope 110 is further advanced by a predetermined distance s until it is paused at a staging position such that the first end 112 of the envelope 110 is located under the flap 106 and is separated from the second end 104 of the envelope 100 by a distance d, as shown in FIG. 3*b*.

Figure 4A:
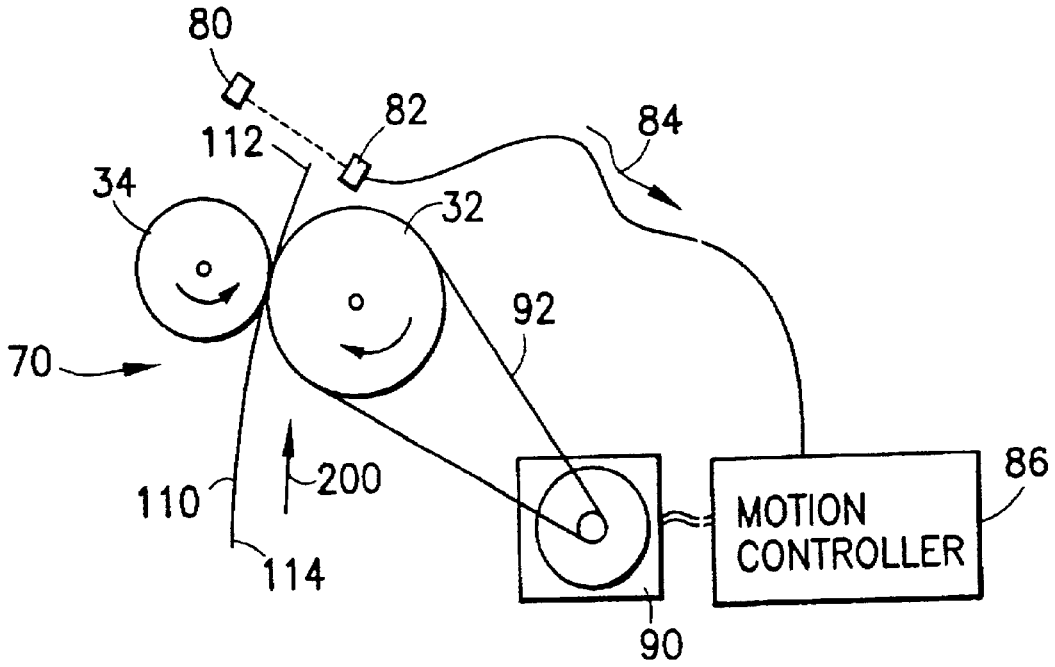
FIG. 4*a* is a diagrammatic representation illustrating the envelope staging apparatus, according to the present invention, for moving envelopes towards the envelope inserting area.
Figure 4B:
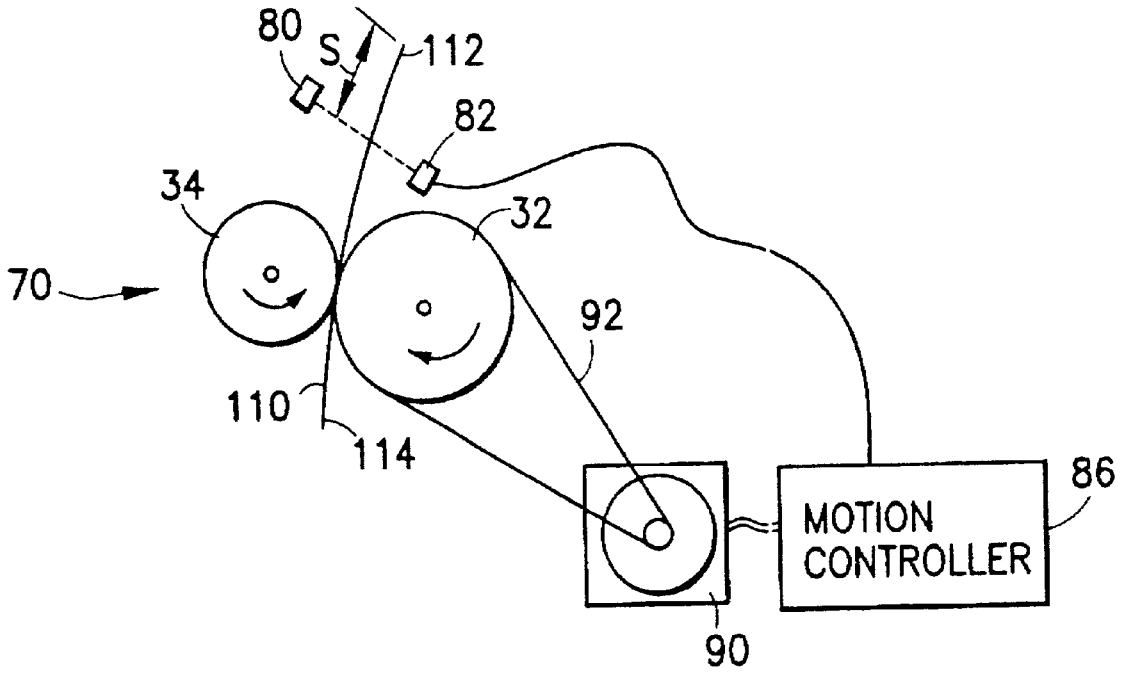
FIG. 4*b* is a diagrammatic representation illustrating an envelope being placed at a staging position by the staging apparatus.

FIGS. 4*a* and 4*b* diagrammatically illustrate an envelope staging apparatus 70 for placing the envelope 100 behind its preceding envelope 110 (FIGS. 1–3*b*). As shown in FIG. 4*a*, the photosensors 80, 82 are placed in the path of the envelope 110 to sense the arrival of the first end 112. When that happens, the photosensors 80, 82 send a signal 84 indicative of the sensing to a motion controller 86, which controls a motor 90. The motor 90 drives the roller 32 with an endless belt 92 to control the movement of the envelope 110. Responsive to the signal 84, the motion controller 84 causes the motor 90 to further move the envelope 110 by a distance s, as shown in FIG. 4*b*. The motor 90 can be a stepping motor or a servo motor. The distance s can be determined by the number of steps of a stepping motor, but it can also be measured by an optical encoder or the like. It is possible that the photosensors 80, 82 be replaced by mechanical switches or the like in order to establish a reference point. The preferred separating distance d between the first end 112 of the envelope 110 and the second end 104 of the envelope 100 is 0.75 inch. It should be noted that the separating distance d can be adjusted depending on the operating speed of the mail insertion machine. Furthermore, the advancing distance s can be changed according to the separating distance d.

Thus, the present invention has been disclosed with respect to the preferred method and embodiment. It should be understood by those skilled in the art that the foregoing and various other changes, omissions and deviations in the form and detail thereof may be made without departing from the spirit and scope of this invention.

What is claimed is:

1. A method of placing a first envelope behind a preceding second envelope which is located in an envelope inserting area in a mail insertion machine, wherein the first and second envelopes have a first end and an opposing second end, and wherein the first envelope is advanced towards the envelope inserting area with the first end leading the second end, and the first end of the first envelope is closer to the second end of the second envelope than the first end of the second envelope, said method comprising the steps of:

sensing the arrival of the first end of the first envelope at a reference point; and responsive to said sensing, further advancing said envelope towards the envelope inserting area by a predetermined distance from the reference point so that the first envelope is paused at a staging position with the first end of the first envelope being located between the reference point and the second end of the second envelope, wherein the second envelope has a flap adjoining and flipped away from the second end of the second envelope, and wherein the flap of the second envelope is partially overlapped with the first end of the first envelope in a shingling fashion when the first envelope is paused at the staging position.

2. The method of claim 1, wherein, when the first envelope is located at the staging position, the first end of the first envelope is separated from the second end of the second envelope by a predetermined gap.

3. The method of claim 2, wherein the predetermined gap is 0.75 inch.

4. The method of claim 2, wherein the predetermined gap is adjustable.

5. An apparatus for placing a first envelope behind a preceding second envelope which is located in an envelope inserting area, via an envelope advancement mechanism, in a mail insertion machine, wherein the first and second envelopes have a first end and an opposing second end, and wherein the first envelope is advanced towards the envelope inserting area with the first end leading the second end, and the first end of the first envelope is closer to the second end of the second envelope than the first end of the second envelope, said apparatus comprising:

first means for sensing the arrival of the first end of the first envelope at a reference point which is located away from the second end of the second envelope and further away from the first end of the second envelope, said first means further providing a signal indicative of said sensing; and second means, responsive to said signal provided by said first means, for further advancing the first envelope towards the envelope inserting area by a predetermined distance from the reference point so that the first envelope is paused at a staging position with the first end of the first envelope being located between the reference point and the second end of the second envelope, wherein the first envelope.

6. The apparatus of claim 5, wherein the reference point and the predetermined distance are set such that when the first envelope is located at the staging position, the first end of the first envelope is separated from the second end of the second envelope by a predetermined gap.

7. The apparatus of claim 5, wherein said first means comprises a photosensor.

8. The apparatus of claim 5, wherein said second means comprises a motor.

9. An apparatus for placing a first envelope behind a preceding second envelope which is located in an envelope inserting area, via an envelope advancement mechanism, in a mail insertion machine, wherein the first and second envelopes have a first end and an opposing second end, and wherein the first envelope is advanced towards the envelope inserting area with the first end leading the second end, and the first end of the first envelope is closer to the second end of the second envelope than the first end of the second envelope, said apparatus comprising:

first means for sensing the arrival of the first end of the first envelope at a reference point which is located away from the second end of the second envelope and further away from the first end of the second envelope, said first means further providing a signal indicative of said sensing; and second means, responsive to said signal provided by said first means, for further advancing the first envelope towards the envelope inserting area by a predetermined distance from the reference point so that the first envelope is paused at a staging position with the first end of the first envelope being located between the reference point and the second end of the second envelope, wherein the second envelope has a flap adjoining the second end of the second envelope and the flap is flipped away therefrom, and wherein the apparatus further comprises a staging device with at least one finger which keeps the first end of the first envelope separated from the flap of the second envelope when the first envelope is paused at the staging position so that the flap of the second envelope is partially overlapped with the first end of the first envelope in a shingling fashion.

10. The apparatus of claim 9, wherein the flap of the second envelope has a size and a shape and wherein the staging device is adjustable to suit the size and the shape of the flap of the second envelope.

* * * * *